US006964179B2

(12) United States Patent
Yoshida

(10) Patent No.: US 6,964,179 B2
(45) Date of Patent: Nov. 15, 2005

(54) PORTABLE CONTAINER

(75) Inventor: Katsuhiko Yoshida, Niigata-ken (JP)

(73) Assignee: Twinbird Corporation

( * ) Notice: Subject to any disclaimer, the term of this patent is extended or adjusted under 35 U.S.C. 154(b) by 0 days.

(21) Appl. No.: 10/910,436

(22) Filed: Aug. 3, 2004

(65) Prior Publication Data

US 2005/0081558 A1 Apr. 21, 2005

(30) Foreign Application Priority Data

Oct. 21, 2003 (JP) ..... 2003-361130

(51) Int. Cl.[7] ..... F17C 13/00; F25B 21/00; F25D 3/08; F25D 23/00

(52) U.S. Cl. ..... 62/457.9; 62/457.1; 62/371; 62/457.7; 220/259.2

(58) Field of Search ..... 62/457.1–457.9, 62/371, 3.1–3.7; 383/110, 111, 7; 220/592.2; D7/605

(56) References Cited

U.S. PATENT DOCUMENTS

| | | | | |
|---|---|---|---|---|
| 3,111,166 A | | 11/1963 | Munz et al. | |
| 4,922,721 A | * | 5/1990 | Robertson et al. | 62/3.61 |
| 5,301,508 A | * | 4/1994 | Kahl et al. | 62/3.62 |
| 5,319,937 A | * | 6/1994 | Fritsch et al. | 62/3.62 |
| D381,870 S | * | 8/1997 | Wedi | D7/605 |
| D497,517 S | * | 10/2004 | Reuter | D7/605 |
| D502,845 S | * | 3/2005 | Wilgus et al. | D7/605 |
| 2002/0005043 A1 | | 1/2002 | Rudick et al. | |
| 2003/0136549 A1 | | 7/2003 | Sone | |

FOREIGN PATENT DOCUMENTS

| | | |
|---|---|---|
| DE | 203 12 383 U1 | 11/2003 |
| EP | 1 167 900 A1 | 1/2002 |
| JP | 05-264153 | 10/1993 |
| JP | 10-148453 | 6/1998 |

* cited by examiner

*Primary Examiner*—Cheryl Tyler
*Assistant Examiner*—Filip Zec
(74) *Attorney, Agent, or Firm*—Akerman Senterfitt

(57) ABSTRACT

A portable container comprising: a box member; a Stirling cooler as a temperature controlling unit for refrigerating the inside of the box member, an operation unit for controlling the Stirling cooler; and handles for supporting the box member by grasping. Cutouts are formed between an upper surface of the box member and both side surfaces thereof, the operation unit is provided on one of the cutouts, and the handles are provided outwardly relative to the cutouts respectively.

6 Claims, 3 Drawing Sheets

PORTABLE CONTAINER

BACKGROUND OF THE INVENTION

1. Field of the Invention

The present invention relates to a portable container.

2. Description of the Related Art

Japanese Patent Unexamined Publication No. 5-264153 discloses a conventional portable container of a type having: a box member; a temperature controlling unit cooling and/or heating the inside of the box member; an operation unit for controlling the temperature controlling unit; and handles. This portable container is a refrigerator having: a casing formed with an opening on an upper surface thereof; a lid (cover) for opening/closing the opening of the casing; a handle formed on the cover for carrying; an electronic cooling element provided inside the casing for cooling the inside thereof; and a control panel provided on a side surface of the casing for controlling the electronic cooling element. Moreover, Japanese Patent Publication No. 2847698 discloses an electronic heating-refrigerating container as this type of the portable container, the electronic heating-refrigerating container having: an insulated box formed with an opening on the upper surface thereof; a lid for opening/closing the opening of the insulated box; handles formed on both the right and left side ends of the insulated box for carrying; an unitized thermo-module and a heat exchanging member provided inside the lid for cooling and heating the inside of the insulated box; and an operation unit provided on the upper surface of the lid for controlling the thermo-module.

Meanwhile, the above-described portable container may be not only carried by hand, but also loaded on a vehicle or the like. In a case where the vehicle loads other baggage or the like, the baggage would move due to: a shock resulting from opening/closing a door, trunk, etc; or a vibration resulting from the travel of the vehicle. Accordingly, the moved baggage may contact the operation unit so that the operation unit may be operated involuntarily. Moreover, in a case where the above-described portable container is used inside a room, a user thereof could accidentally kick it or hit it to other furniture. Accordingly, the operation unit may be operated involuntarily. In order to prevent those accidental operations, some ideas can be considered, such as: providing the operation unit on a concaved portion; providing an openable and closable cover on the operation unit.

The structure employed by the first idea, however, is not preferable from a standpoint of design since the concaved portion is formed on the surface of the insulated box, while this idea is not practical in a case where the area of the operation unit is large. Meanwhile, in the structure employed by the second idea, it is necessary to open or close the cover whenever the operation unit is operated, and thus operationality thereof is inferior.

SUMMARY OF THE INVENTION

The present invention has been made to solve the above problems. It is, therefore, an object of the present invention to provide a portable container which can allow a user to easily operate an operation unit, and prevent the operation unit from accidental operation.

In order to attain the above object, according to a first aspect of the present invention, there is provided a portable container comprising: a box member; a temperature controlling unit cooling and/or heating an inside of the box member; an operation unit for controlling the temperature controlling unit; and handles, wherein: cutouts are formed between an upper surface of the box member and both side surfaces thereof; the operation unit is provided on one of the cutouts; and the handles are formed on upper portions of the side surfaces, each of the upper portions of the side surfaces locating adjacent to an upper portion of each of said cutouts.

By employing the above-described structure, a superior operationality of the operation unit can be ensured by allowing a user to operate the operation unit which is provided on the cutout, while a possibility for accidental operation of the operation unit can be decreased since the handle prevents other objects from contacting the operation unit when installed and carried.

Alternatively, in the above-described portable container, a portion of the cutout on which the operation unit is provided may incline from an inwardly concaved portion of the cutout toward the side surface of the box member.

Since the operation unit is formed on the portion of the cutout inclining from inwardly concaved portion thereof toward the side surface of the box member, visibility and operationality of the operation unit can be improved.

Moreover, in the above-described portable container, an upper surface of each handle may be formed so as to be essentially in the same plane as the upper surface of the box member; and a side surface of each handle may be formed so as to be essentially in the same plane as the side surface of the box member.

By employing this structure, the handle and the operation unit position relatively close to each other, and thus the handle can certainly prevent other objects from contacting the operation unit when the portable container is installed and carried, while the handles do not disturb a user when he/she installs and carries the portable container since the handles do not protrude from the box member in a longitudinal and transverse direction of the box member.

Further, in the above-described portable container, the temperature controlling unit may cool the inside of said box member, the temperature controlling unit comprising: a Stirling cooler; and a thermosiphon.

Still further, the box member may have: an inlet for introducing outside air into the inside of the box member; and a blower fan providing the outside air to the Stirling cooler via the inlet so as to cool the Stirling cooler.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

Figure 1:
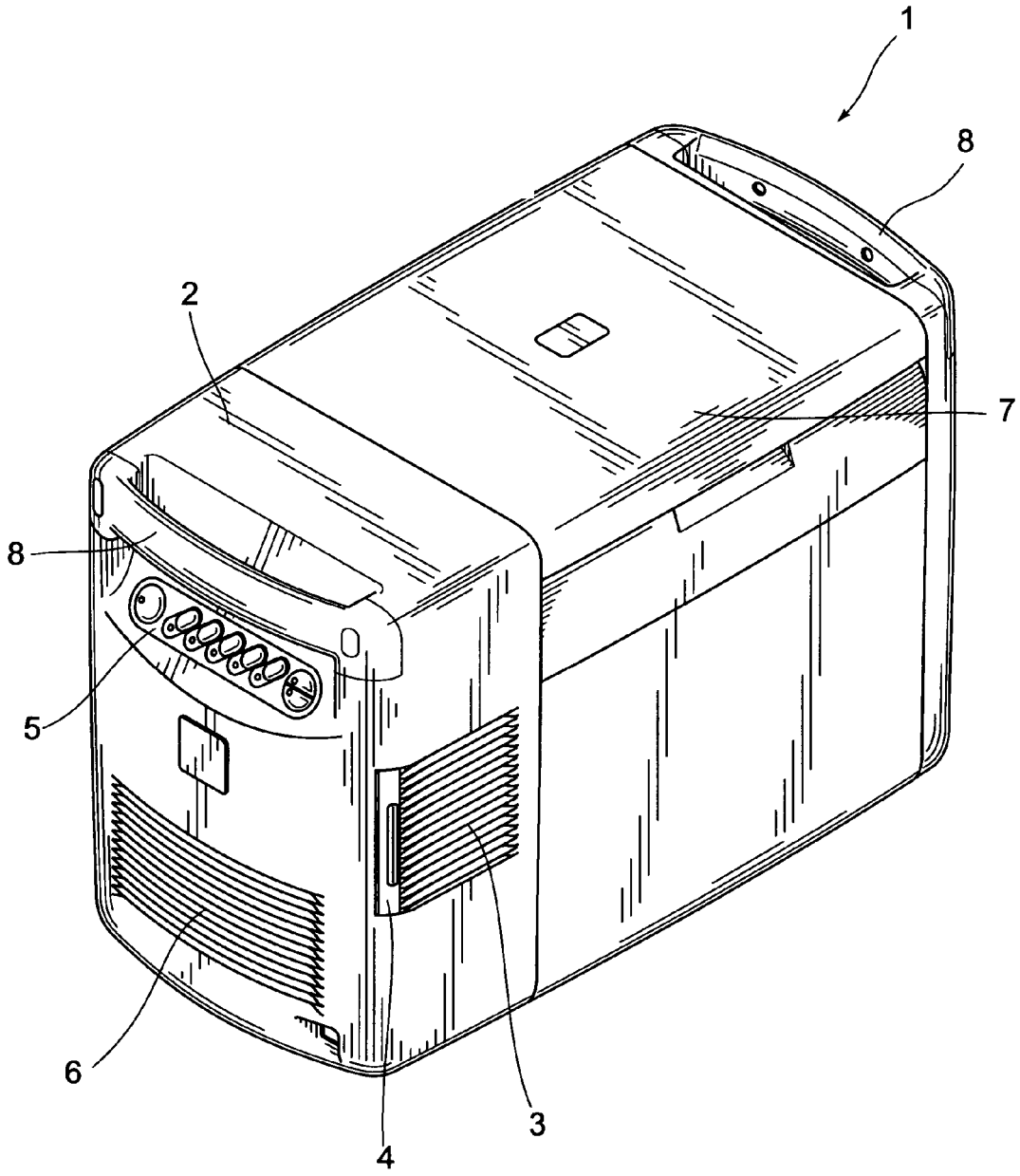
FIG. 1 is a perspective view showing a portable container according to a preferred embodiment of the present invention.
Figure 2:
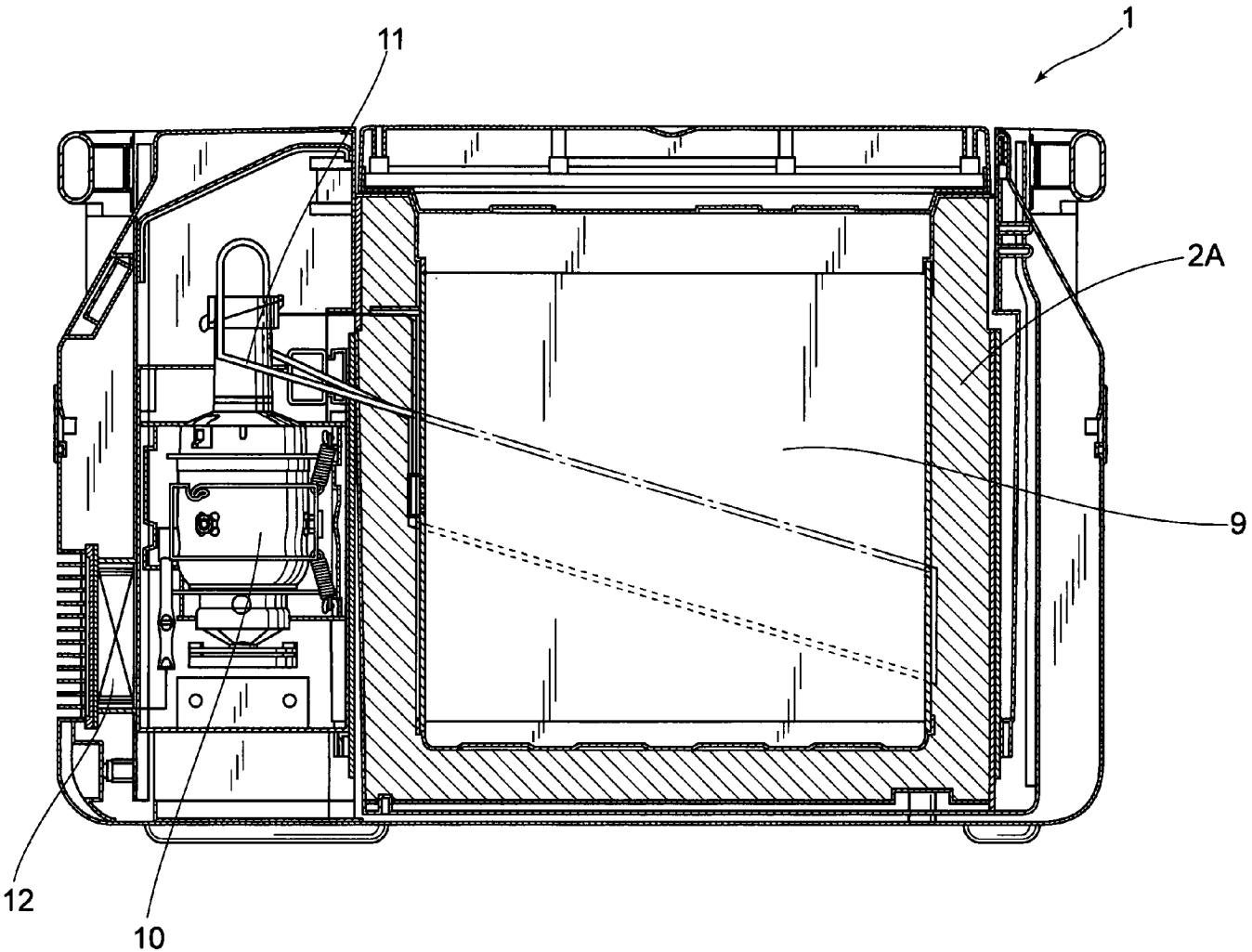
FIG. 2 is a vertical cross sectional view showing the portable container of FIG. 1.

A portable container according to a preferred embodiment of the present invention will now be described in detail with reference to the accompanying drawings. FIGS. 1 to 3 are views for explaining the portable container according to the preferred embodiment of the present invention.

FIG. 1 is a perspective view showing the portable container 1 of this embodiment. The portable container 1 includes a box member 2. This box member 2 constitutes outer walls of the portable container 1. An inlet 3 for introducing outside air into the inside of the box member 2 is provided on the left side of the front of the box member 2. Meanwhile, a filter 4 for removing dusts in the introduced outside air is provided on the inner side of the inlet 3. Moreover, an operation unit 5 for controlling the portable container 1 is provided on an upper portion of a left side surface of the box member 2. Further, an outlet 6 for exhausting the outside air provided inside the box member 2 via the inlet 3 is provided on a lower position of the left side surface of the box member 2. Still further, a lid 7 for opening/closing an upper opening of the portable container 1 is provided on an upper portion of the box member 2. Meanwhile, handles 8 for carrying the portable container 1 are provided on both upper ends of the box member 2 respectively.

FIG. 2 is a vertical cross sectional view showing the above-described portable container 1. The portable container 1 has a storing member 9 surrounded by an insulator 2A. A Stirling cooler 10 as a temperature controlling unit is provided on the left of the storing member 9. Meanwhile, since the Stirling cooler 10 is well known to a person skilled in the art, detailed explanations thereof will be omitted in this specification. A distal end of the Stirling cooler 10 subjected to lower temperature is connected to a thermosiphon 11 comprising, for example, a copper made piping, while the piping thereof is fixed around the storing member 9 in a condition where it thermally contacts there. The distal end of the Stirling cooler 10 is refrigerated when the Stirling cooler 10 is operated, and thus the storing member 9 is refrigerated when cold is moved due to non-illustrated refrigerant inside the thermosiphon 11. Moreover, a blower fan 12 for providing the outside air to the Stirling cooler 10 via the inlet 3 is provided on the lower position of the left side of the Stirling cooler 10. The blower fan 12 cools a driving member and heat dissipation member of the Stirling cooler 10.

Figure 3A:
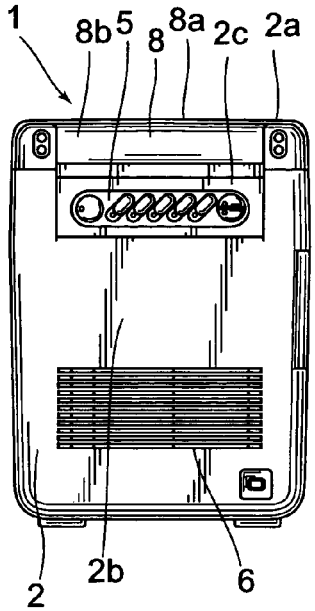
FIG. 3A is a left side view of the portable container.
Figure 3B:
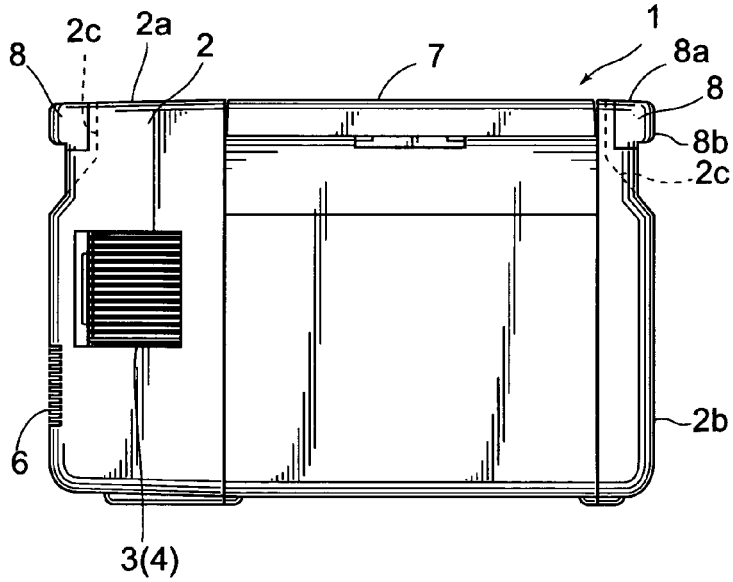
FIG. 3B is a front view thereof.
Figure 3C:
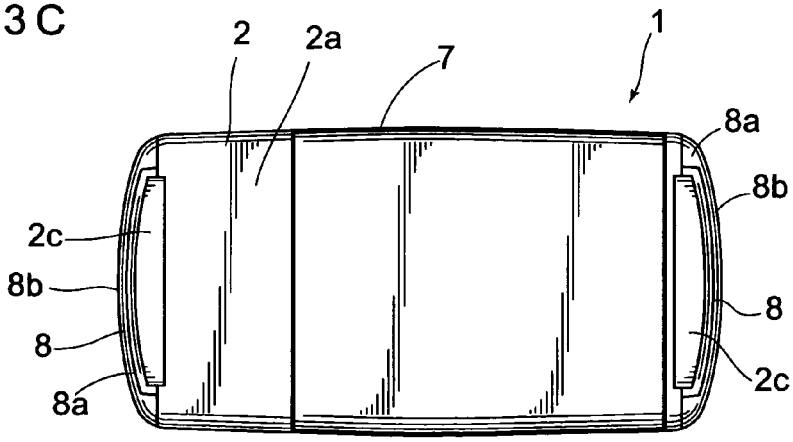
FIG. 3C is a plan view thereof.

FIGS. 3A to 3C are external views showing the portable container 1. FIG. 3A is a left side view of the portable container 1, FIG. 3B is a front view thereof, and FIG. 3C is a plan view thereof. Cutouts 2*c* are formed between an upper surface 2*a* and both side surfaces 2*b*. The cutouts 2*c* are formed inwardly relative to the side surfaces 2*b* of the box member 2. Moreover, the cutouts 2*c* are formed so as to have portions inclining from inwardly concaved portions of the cutouts 2*c* toward the side surfaces 2*b*. The operation unit 5 is provided on the left cutout 2*c*. Meanwhile, the operation unit 5 is one to control the Stirling cooler 10 so as to control the portable container 1. The operation unit 5 includes: a switch for controlling the portable container 1 on and off; at least one temperature controlling switch for setting the temperature of the inside of the storing member 9 gradually; indicator lamps for indicating condition selected by the switches; etc. Each of the handles 8 is provided outwardly relative to the respective cutout 2*c*, while it is connected to the front and rear ends of the box member 2. Meanwhile, an upper surface 8*a* of each handle 8 is formed so as to be essentially in the same plane as the upper surface 2*a* of the box member 2, while a side surface 8*b* of each handle 8 is formed so as to be essentially in the same plane as the side surface 2*b* of the box member 2.

As described, according to this embodiment, the portable container 1 employs a structure that: the cutouts 2*c* are formed between the upper surface 2*a* and both side surfaces 2*b* of the box member 2; the operation unit 5 is provided on the left cutout 2*c;* and the handles 8 are formed outwardly relative to the cutouts 2*c* respectively. Accordingly, a superior operationality of the operation unit 5 can be ensured by allowing a user to operate the operation unit 5 provided on the cutout 2*c*, while a possibility for accidental operation of the operation unit 5 can be decreased since the handle 8 prevents other objects from contacting the operation unit 5 when installed and carried.

Moreover, according to this embodiment, visibility and operationality of the operation unit 5 can be improved since it is provided on the portion of the cutout 2*c* inclining from the inwardly concaved portion thereof toward the side surfaces 2*b*.

Further, according to this embodiment, the handle 8 and the operation unit 5 position relatively close to each other since the upper surface 8*a* of each handle 8 is formed so as to be essentially in the same plane as the upper surface 2*a* of the box member 2, while the side surface 8*b* of each handle 8 is formed so as to be essentially in the same plane as the side surface 2*b* of the box member 2. Accordingly, the handle 8 can certainly prevent other objects from contacting the operation unit 5 when installed and carried, while the handles 8 do not disturb a user when he/she installs and carries the portable container 1.

Various embodiments and changes may be made thereonto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention within the claims are to be regarded to be in the scope of the present invention. For example, whilst the Stirling cooler is used as the temperature controlling unit in the above-described embodiment, but the portable container is not limited to this type. For example, the portable container may be an electronic hot and cold container using a thermo-module comprising an aggregate of peltier devices for heating or cooling inside thereof. Moreover, the portable container may be a compressor type refrigerator. Further, the portable container may be a heat-retention container using a heater or the like.

What is claimed is:

1. A portable container comprising: a box member; a temperature controlling unit cooling and/or heating an inside of said box member; an operation unit for controlling said temperature controlling unit; and handles, wherein:

cutouts are formed between an upper surface of said box member and both side surfaces thereof;

said operation unit is provided on one of said cutouts; and said handles are formed on upper portions of said side surfaces, each of the upper portions of the side surfaces locating adjacent to an upper portion of each of said cutouts.

2. The portable container according to claim 1, wherein a portion of said cutout on which said operation unit is provided inclines from an inwardly concaved portion of said cutout toward said side surface.

3. The portable container according to claim 1, wherein:

an upper surface of each handle is formed so as to be essentially in a same plane as said upper surface of said box member; and a side surface of each handle is formed so as to be essentially in a same plane as said side surface of said box member.

4. The portable container according to claim 2, wherein:

an upper surface of each handle is formed so as to be essentially in a same plane as said upper surface of said box member; and a side surface of each handle is formed so as to be essentially in a same plane as said side surface of said box member.

5. The portable container according to claim 1, wherein said temperature controlling unit cools the inside of said box member, said temperature controlling unit comprising: a Stirling cooler; and a thermosiphon.

6. The portable container according to claim 5, wherein said box member has: an inlet for introducing outside air into the inside of said box member; and a blower fan providing the outside air to said Stirling cooler via said inlet so as to cool said Stirling cooler.

* * * * *